United States Patent [19]

Barth

[11] 3,987,618

[45] Oct. 26, 1976

[54] HAND SETTING DEVICE FOR SMALL SWITCHES

[75] Inventor: Manfred Hans Barth, Calmbach, Germany

[73] Assignee: Timex Corporation, Waterbury, Conn.

[22] Filed: June 25, 1975

[21] Appl. No.: 590,175

[30] Foreign Application Priority Data

Sept. 7, 1974 Germany ..... 2442950

[52] U.S. Cl. ..... 58/85.5; 58/34

[51] Int. Cl.² ..... G04B 27/00; G04B 27/08

[58] Field of Search ..... 58/23 R, 34, 38, 575, 58/58, 85.5

[56] References Cited

UNITED STATES PATENTS

| | | | |
|---|---|---|---|
| 3,248,868 | 5/1966 | Polo | 58/58 |
| 3,421,311 | 1/1969 | Bennet | 58/85.5 |
| 3,609,954 | 10/1971 | Hougendobler | 58/85.5 |
| 3,756,015 | 9/1973 | Saito | 58/42.5 |
| 3,765,164 | 10/1973 | Esselborn | 58/85.5 |

FOREIGN PATENTS OR APPLICATIONS

| | | | |
|---|---|---|---|
| 734,618 | 8/1956 | United Kingdom | 58/85.5 |

*Primary Examiner*—George H. Miller, Jr.
*Assistant Examiner*—Vit W. Miska

[57] ABSTRACT

A hand setting device for small watches with an axially movable hand setting stem which has a recess into which a setting lever engages, rotary positioned at a front frame, which serves for operating a rocking bar which is effected by a return spring, which carries at least one tooth wheel that can engage and disengage with the setting pinion for the hands.

5 Claims, 3 Drawing Figures

HAND SETTING DEVICE FOR SMALL SWITCHES

Figure 1:
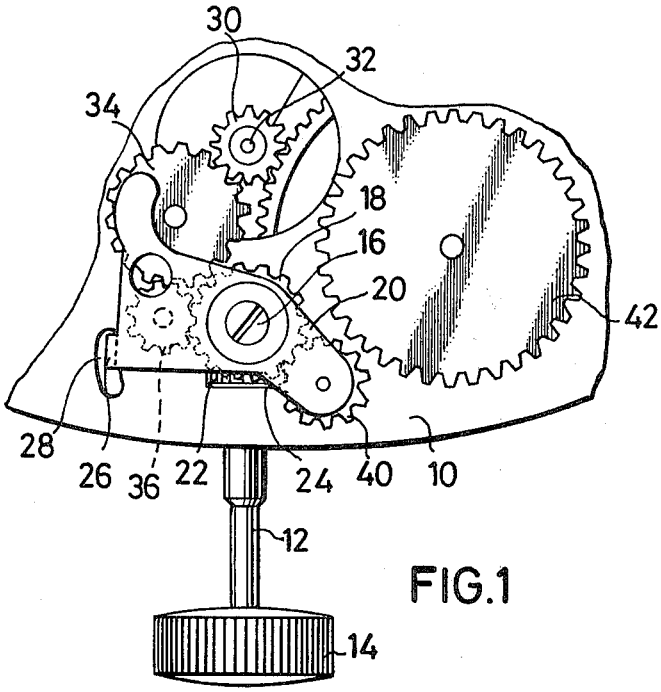

The invention concerns a hand setting device for small watches and, in particular for wristwatches. It is usual with known watches to position the setting lever by means of a screw threaded into the front frame. For this purpose the setting lever has between its ends a hold which is penetrated by the screw, and a taphole is planned in the front frame. The setting lever engages with its cranked end, which faces the hand setting stem, into a groove of the hand setting stem so that the setting lever can be swiveled by an axial movement of the hand setting stem. The return spring for the rocking bar is formed as a buffer spring with two free ends, one of these rests against the rocking bar and the other is fixed by a pivot of the aforementioned front frame. Under the influence of the buffer spring the bent end of the rocking bar rests against the setting lever and also protrudes through the opening in the front frame, and when pulling the hand setting stem out, the rocking bar is swiveled in opposition to the buffer spring, so that a tooth wheel positioned at same engages with two not directly meshing tooth wheels of the setting pinion for the hand.

The known construction has various disadvantages: In the first place a taphole for the screw positioning the setting lever must be cut in the front frame; in the course of automatic assembly it is exceptionally difficult to tighten the screws; if the screw positioning the setting lever is tightened too much, then it is difficult to pull out the hand setting stem, but if the screw is not tightened enough then it might loosen and after operating the hand setting stem several times it might fall out of the threading; screw-breaks happen repeatedly with known watches because the screw shaft must be relatively thin with small watches, and this thin screw shaft is weakened by the notch-effect caused by the threading; finally, when exchanging the hand setting stem — which is quite often necessary—the screw positioning the setting lever must be removed and later screwed into the front frame again.

Most of these disadvantages effect the manufacturing costs of the watch, which becomes more important in the manufacture of relatively inexpensive watches.

SUMMARY OF THE INVENTION

Therefore, it was the object of the invention to improve the hand setting of the type mentioned in the beginning in such a way to allow an automatic assembly. This problem is solved in accordance with the invention by positioning the setting lever in the front frame by means of a pivot with axial play, which is firmly fixed to same or the front frame, and that the return spring for the rocking bar is planned to eliminate this axial play and to hold the setting lever in its operating position. As mentioned, the pivot is planned directly at the setting lever, it can, for instance, be formed at same, so that one only has to insert it into a bearing drilling, as the return spring would prevent it from falling out of the drilling. With a preferred type of construction of the invention, the pivot is riveted or pressed into the front frame. The firm, undetachable connection of the pivot with the setting lever or the front frame has the advantages that the fastening of the bearing element for the setting lever to the front frame can be automated, whereby the danger of this bearing element becoming disconnected from the front frame is eliminated. By holding the setting lever flexible in its operating position it is possible to construct the hand setting stem light and simple, it is only necessary to lift the setting lever in opposition to the spring, and then to develop the hand setting stem. Finally, it is proved that by the inventionwise type of positioning the setting lever, breaking of the bearing element, i.e. the pivot, can be prevented. And no altered part is required for securing the setting lever in its bearing position, since the return spring for the rocking bar also forms the spring for the holding-down of the setting lever, which can be accomplished in a very simple way by making the free end of the return spring of the rocking bar, which is formed as a buffer spring and does not rest against the rocking bar, long enough to rest against the bearing pivot for the setting lever.

With a preferred type of construction of the invention is the maximum diameter of the pivot — naturally above the front frame — at the most equal to the diameter of a taphole in the setting lever and the pivot has in its circumference at least one recess for positioning the spring. This enables the fastening of the pivot in the front frame prior to the final assembly, and later only the setting lever must be pushed onto the pivot and secured by locking the spring in the mentioned recess.

If the pivot has a collar approximately at a distance of the spring wire diameter above the setting lever, then the operating position of the setting lever is determined by letting the spring lock below the collar. When exchanging the hand setting stem it is only necessary to lift the spring over the collar so it will rest above the collar and against the pivot and the setting lever can be lifted that much, that it releases the notch in the hand setting stem, into which it normally engages.

Figure 3:
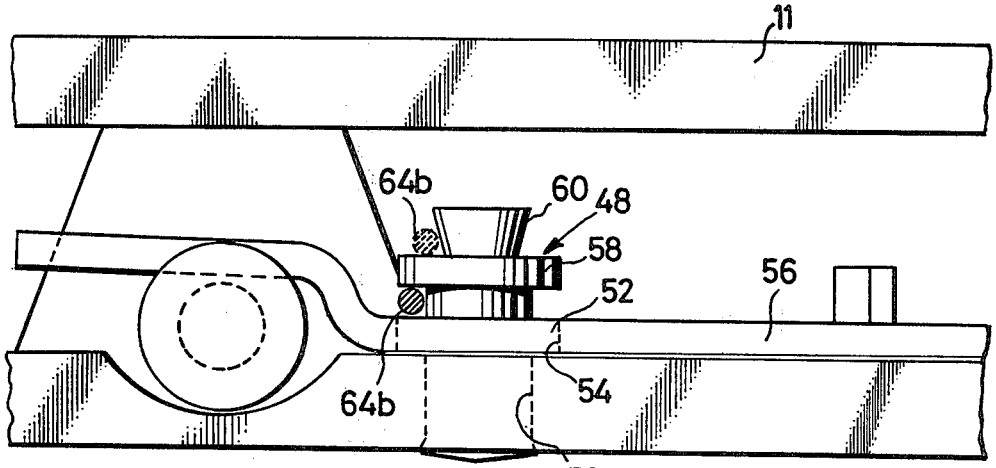
Figure 2:
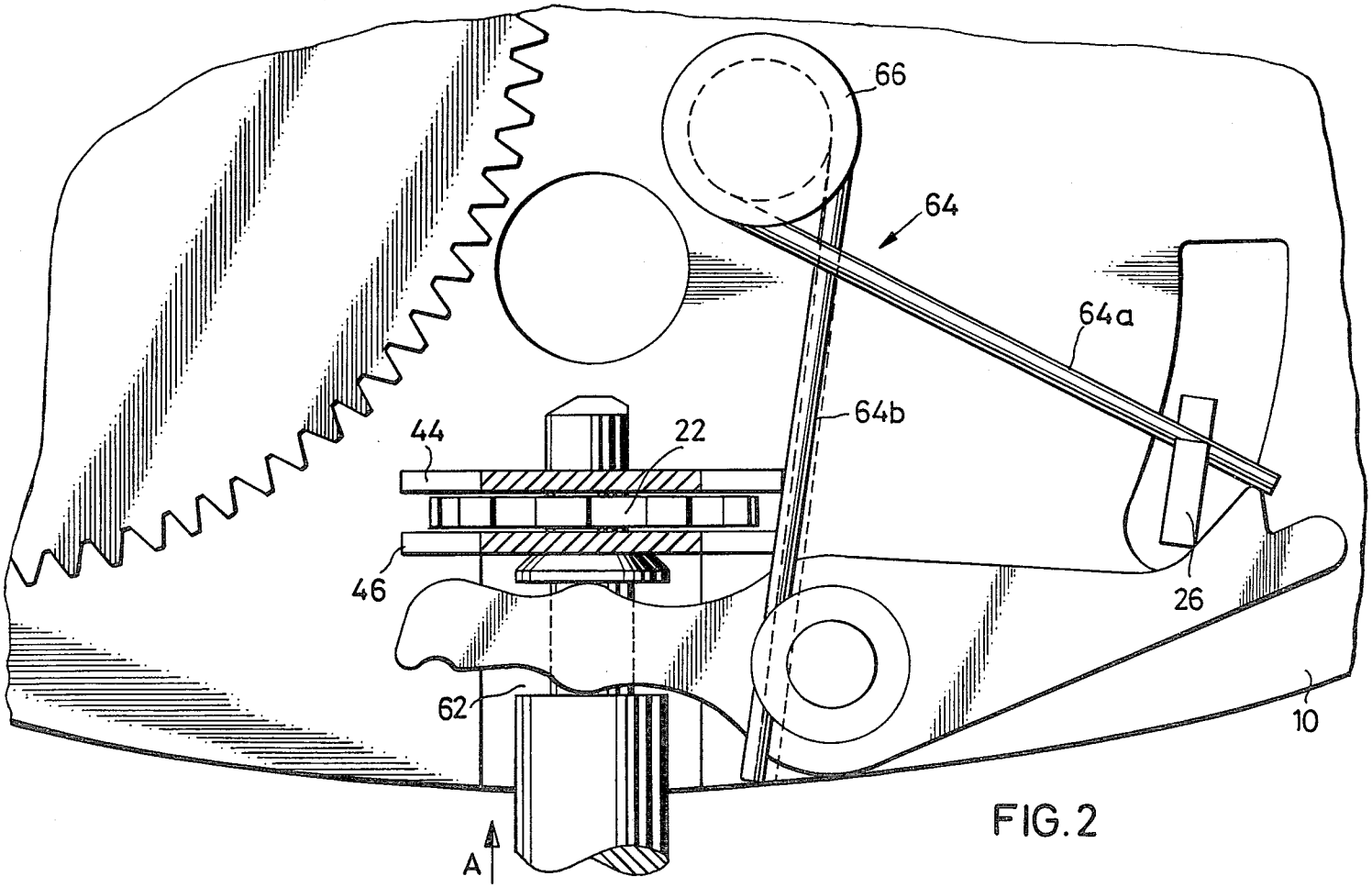

Further characteristics, advantages and details of the invention can be seen from the attached claims and/or from the following description and the attached graphic illustration of a preferred type of construction of the invention; shown are:

FIG. 1 a top view on that area of the front side of the watch movement comprising the hand setting device;

FIG. 2 a top view on the rear side of the watch movement, but with the bottom plate removed, and FIG. 3 a side view of the watch movement per arrow A in FIG. 2, with the bottom plate also indicated.

The FIG. 1 shows a part of a movement frame 10, on its lower side is a hand setting stem 12 with crown 14 rotary positioned — the positioning is further explained by FIGS. 2 and 3.

A tooth wheel 18 and a rocking bar, as a unit marked 20, are by means of a screw 16 rotary positioned on the movement frame 10, and the tooth wheel 18 meshes with a notch 22 which is fastened on the inner end of the hand setting stem 12 and passes through an opening 24 in the movement frame 10. At its left lower end, in accordance with FIG. 1, the rocking bar 20 has a tab 26 which is bent downwards, which passes through a slot 28 in the movement frame 10. The rocking bar 20 can therefore be swiveled to-and-fro between two end positions in which the tab 26 strikes against the ends of the slot 28. Positioned on the minute stem 32 is a pinion marked 30, which is in constant mesh with an intermediate gear wheel 34, positioned on the movement frame 10. Positioned on the lower side of the rocking bar 20 is a further intermediate gear wheel 36, which is in constant mesh with the tooth wheel 18. When the rocking bar 20 takes up its end position, shown in FIG. 1, then the intermediate gear wheel 36 meshes also with the intermediate gear wheel 34, so that by turning the hand setting stem 12 the minute stem 32 and thereby the minute and the hour hand, which are not shown, can be set. When the rocking bar 20 is swiveled counterclockwise around the screw 16 until the tab 26 strikes the lower end of the slot 28, then the gear connection between the hand setting stem 12 and the minute stem 32 is interrupted, since the intermediate gear wheel 36 is lifted from the intermediate gear wheel 34. It is further mentioned that with the rocking bar in this position, a spring of the watch movement can be wound, also via the tooth wheel 18 and an intermediate gear wheel 40, which is positioned at the right end of the rocking bar 20 at its lower side and in the end position, which is not shown, of the rocking bar meshes with a tooth wheel 42, which is fixed at the movement frame 10 and is in torsion strong connection with the one end of the main spring, which is not shown.

As can be seen from FIGS. 2 and 3 the hand setting stem 12 is positioned between two brackets 44 and 46 which extend between the frame 10 and a further frame 11 and between them receive the pinion 22. As can be seen, particularly from FIG. 3, a pivot 48, formed as a profile turned piece, is pressed into a hole 50 of the frame 10 or riveted to its front side. This pivot has a first collar 52, its diameter is the same or smaller than that of a taphole 54 in a setting lever, as a unit marked 56. Spaced from this collar the pivot has a second collar 58 of approximately the same diameter and it ends, for example, with a frustum shaped end-piece 60. With its left end, which is bent at right angle per FIG. 2, the setting lever 56 engages in its operating position, shown in FIG. 3, in a groove 62 of the hand setting stem 12, while the other end of the setting lever rests against the bent tab 26 of the rocking bar 20. A buffer and/or return spring, as a unit marked 64, is carried by a pivot 66 which is fastened on the frame 10, and one free end **64*a* of the buffer spring rests against the tab 26 of the rocking bar 20, while the other free end 64*b* serves to secure the setting lever 56. For this purpose the distance of collar 58 from 52 of the pivot 48 was chosen to be equal to the diameter of the spring wire of the buffer spring 64, so that the free end 64*b* of the buffer spring can be inserted between the collar 58 and the setting lever 56, in order to secure the latter in its operating position. If the hand setting stem 12 is to be removed, then it is sufficient to lift the free end 64*b* of the buffer spring over the collar 58 of the pivot 48 into the position indicated in broken lines in FIG. 3, because the left end of the setting lever, per FIG. 3, can then be lifted, so as not to engage any more in the groove 62** of the hand setting stem.

As is generally known, the rocking bar 20 can, in opposition to the buffer spring 64 serving as return spring, be swiveled into its position as shown in FIG. 1 by pulling the hand setting stem 12 outwards, opposite to the arrow A in FIG. 2.

It can be seen from the foregoing description that the pivot 48 can in the course of a fully automatic assembly easily be fastened in the frame 10. Then it is only necessary to slide the setting lever 56 onto the pivot and to let the free end **64*b* of the buffer spring lock below the collar 58**.

I claim:

1. Hand setting device for watches with an axially and rotary movable hand setting stem which has a recess into which engages a setting lever, said setting lever operating a rocking bar which is under the influence of a return spring, the rocking bar carries at least one tooth wheel that can engage and disengage with the setting pinion for the hands, wherein the improvement comprises:

means forming a pivot for said setting lever having axial play with respect to said pivot; and spring means having a first portion acting as a return spring for the rocking bar and a second portion which coacts.

2. Hand setting device as in claim 1 wherein: the watch has a front frame, said pivot being fastened to said front frame.

3. Hand setting device as in claim 1 wherein:

the setting lever has portions forming a taphole having a first diameter, and the means forming a pivot has a shaft portion with a second diameter which is equal to or less than said first diameter for being inserted into said taphole, and at least one circumferencial recess for positioning a portion of the return spring.

4. Hand setting device as in claim 1, wherein:

the return spring is a buffer spring with two free ends, one of which rests against the rocking bar and the other free end of the buffer spring rests against the pivot.

5. Hand setting device as in claim 1, wherein:

the pivot has a collar approximately at the distance of the spring wire diameter above the setting lever.

* * * * *

UNITED STATES PATENT OFFICE

CERTIFICATE OF CORRECTION

Patent No. 3,987,618 Dated October 26, 1976

Inventor(s) Manfred Hans Barth

It is certified that error appears in the above-identified patent and that said Letters Patent are hereby corrected as shown below:

On the Title Page, Item 54 should read:

--- HAND SETTING DEVICE FOR SMALL WATCHES ---.

Signed and Sealed this

Fourth Day of January 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,987,618 Dated October 26, 1976

Inventor(s) Manfred Hans Barth

It is certified that error appears in the above-identified patent and that said Letters Patent are hereby corrected as shown below:

Column 4, after line 29, -- with said pivot for eliminating said axial play of the setting lever and for holding down the setting lever in its operating position. -- should be inserted.

Signed and Sealed this

Fifteenth Day of February 1977

[SEAL]

*Attest:*

RUTH C. MASON
*Attesting Officer*

C. MARSHALL DANN
*Commissioner of Patents and Trademarks*